US012263382B2

(12) United States Patent
Engle et al.

(10) Patent No.: US 12,263,382 B2
(45) Date of Patent: Apr. 1, 2025

(54) GOLF BALL DIMPLES DEFINED BY SUPERPOSED CURVE WITH DECAYING FEATURE

(71) Applicant: Acushnet Company, Fairhaven, MA (US)

(72) Inventors: Courtney N. Engle, Fall River, MA (US); Michael R. Madson, Easton, MA (US); Nicholas M. Nardacci, Barrington, RI (US)

(73) Assignee: Acushnet Company, Fairhaven, MA (US)

( * ) Notice: Subject to any disclaimer, the term of this patent is extended or adjusted under 35 U.S.C. 154(b) by 0 days.

(21) Appl. No.: 18/209,635

(22) Filed: Jun. 14, 2023

(65) Prior Publication Data

US 2024/0416184 A1 Dec. 19, 2024

(51) Int. Cl.
*A63B 37/06* (2006.01)
*A63B 37/00* (2006.01)

(52) U.S. Cl.
CPC ..... *A63B 37/0006* (2013.01); *A63B 37/0015* (2013.01)

(58) Field of Classification Search
CPC ..... A63B 37/0012
See application file for complete search history.

(56) References Cited

U.S. PATENT DOCUMENTS 4,925,193 A 5/1990 Melvin et al.
5,249,804 A 10/1993 Sanchez
5,562,552 A 10/1996 Thurman
5,575,477 A 11/1996 Hwang
5,713,801 A 2/1998 Aoyama
5,735,757 A 4/1998 Moriyama
5,803,831 A 9/1998 Sullivan et al.
5,885,172 A 3/1999 Hebert et al.
5,919,100 A 7/1999 Boehm et al.
5,957,787 A 9/1999 Hwang
5,965,669 A 10/1999 Cavallaro et al.
5,981,654 A 11/1999 Rajagopalan
5,981,658 A 11/1999 Rajagopalan et al.
6,149,535 A 11/2000 Bissonnette et al.
6,162,136 A 12/2000 Aoyama
6,338,684 B1 1/2002 Winfield et al.
6,796,912 B2 9/2004 Dalton et al.
7,163,472 B2 1/2007 Dalton et al.
7,491,137 B2 2/2009 Bissonnette et al.
7,641,572 B2 1/2010 Aoyama
7,887,439 B2 2/2011 Aoyama et al.
9,782,628 B2 10/2017 Madson et al.
2008/0220907 A1 9/2008 Aoyama et al.
2012/0122613 A1 5/2012 Madson
2012/0165130 A1* 6/2012 Madson ..... A63B 37/0015 473/383

(Continued)

*Primary Examiner* — Raeann Gorden

(74) *Attorney, Agent, or Firm* — Thomas P. Gushue

(57) ABSTRACT

A golf ball having a plurality of dimples on a surface thereof is disclosed herein. At least a first group of the plurality of dimples has a cross-sectional dimple profile defined by a superposed function resulting from a sum of at least a first function and a second function. The first function can be defined by at least one of: a circular arc or a catenary curve, and the second function can be defined by a decaying sinusoidal function.

20 Claims, 7 Drawing Sheets

(56) References Cited

U.S. PATENT DOCUMENTS

| | | | | |
|---|---|---|---|---|
| 2015/0045150 | A1* | 2/2015 | Hixenbaugh ..... | A63B 37/0021 473/383 |
| 2016/0129314 | A1 | 5/2016 | Nardacci et al. | |
| 2020/0398115 | A1 | 12/2020 | Madson et al. | |

* cited by examiner

GOLF BALL DIMPLES DEFINED BY SUPERPOSED CURVE WITH DECAYING FEATURE

FIELD OF THE INVENTION

The present disclosure relates to golf ball dimples, and more particularly relates to a golf ball dimple profile being defined by a superposed curve having a decaying feature.

BACKGROUND OF THE INVENTION

Golf balls were originally made with smooth outer surfaces. In the late nineteenth century, players observed that the gutta-percha golf balls traveled further as they got older and more gouged up. The players then began to roughen the surface of new golf balls with a hammer to increase flight distance. Manufacturers soon caught on and began molding non-smooth outer surfaces on golf balls.

By the mid 1900s, almost every golf ball being made had 336 dimples arranged in an octahedral pattern. Generally, these balls had about 60 percent of their outer surface covered by dimples. Over time, improvements in ball performance were developed by utilizing different dimple patterns. In 1983, for instance, Titleist introduced the TITLEIST® 384, which had 384 dimples that were arranged in an icosahedral pattern. About 76 percent of its outer surface was covered with dimples and the golf ball exhibited improved aerodynamic performance. Today, dimpled golf balls travel nearly two times farther than a similar ball without dimples.

The dimples on a golf ball are important in reducing drag and increasing lift. Drag is the air resistance that acts on the golf ball in the opposite direction from the ball flight direction. As the ball travels through the air, the air surrounding the ball has different velocities and, thus, different pressures. The air exerts maximum pressure at the stagnation point on the front of the ball. The air then flows over the sides of the ball and has increased velocity and reduced pressure. At some point it separates from the surface of the ball, leaving a large turbulent flow area called the wake that has low pressure. The difference in the high pressure in front of the ball and the low pressure behind the ball slows the ball down. This is the primary source of drag for a golf ball.

The dimples on the ball create a turbulent boundary layer around the ball, i.e., a thin layer of air adjacent to the ball flows in a turbulent manner. The turbulence energizes the boundary layer of air around the ball and helps it stay attached further around the ball to reduce the area of the wake. This greatly increases the pressure behind the ball and substantially reduces the drag.

Lift is the upward force on the ball that is created from a difference in pressure on the top of the ball to the bottom of the ball. The difference in pressure is created by a warpage in the air flow resulting from the ball's back spin. Due to the back spin, the top of the ball moves with the air flow, which delays the separation to a point further aft. Conversely, the bottom of the ball moves against the air flow, moving the separation point forward. This asymmetrical separation creates an arch in the flow pattern, requiring the air over the top of the ball to move faster, and thus have lower pressure than the air underneath the ball.

Golf ball manufacturers extensively study the effect of dimple shape, volume, and cross-section on overall flight performance of the ball. For example, U.S. Pat. No. 5,735,757 discusses making dimples using two different spherical radii with an inflection point where the two curves meet. In most cases, however, the cross-sectional profiles of dimples in prior art golf balls are parabolic curves, ellipses, semi-spherical curves, saucer-shaped, a sine curve, a truncated cone, or a flattened trapezoid. One disadvantage of these shapes is that they can sharply intrude into the surface of the ball, which may cause the drag to become greater than the lift. As a result, the ball may not make best use of momentum initially imparted thereto, resulting in an insufficient carry of the ball.

Golf ball manufacturers also research dimple patterns, including, for example, overall dimple count and surface coverage, in order to improve the aerodynamic forces on the ball during flight and increase the distance traveled by a golf ball. A high degree of dimple coverage is generally beneficial to flight distance, but only if the dimples are of preferred size and shape. For example, dimple coverage gained by filling spaces with tiny dimples is generally not very effective, since tiny dimples are not good turbulence generators.

Most prior art dimple patterns utilize a dimple count of 250 to 400 with a surface coverage of 75% or greater. For dimple counts less than 250, if the surface coverage is to be maintained, larger average dimple diameters are required, which may lead to diminished aerodynamic efficiency.

The present disclosure seeks to provide, among other advantages, the ability to modify dimple profiles by adjusting the effects of functions that comprise the dimple profile.

SUMMARY OF THE INVENTION

Dimple cross-sectional profiles generated by the superposition of two or more functions can provide a variety of solutions for improving aerodynamic performance, one of which is the introduction of a secondary turbulence-generating roughness on the surface of the golf ball to promote delayed separation from the golf ball's surface and ultimately decrease the size of the wake region trailing the golf ball.

Golf ball dimple profiles disclosed herein can be defined by a first function and a second function. In one aspect, the first and second functions are roughness-generating functions. As disclosed herein, the addition of a decaying feature or element allows for an additional level of definition for the dimple profile, and can concentrate the effects of one of the functions defining the dimple profile. In one aspect, the decaying element can be provided in a secondary roughness-generating function. The introduction of a decaying element relative to at least one of the functions can provide a profile in which the central region of the dimple profile is fully pronounced and oscillates prominently (i.e., undamped), while minimizing the effect of oscillations near the dimple-free land area.

By suppressing the oscillation near the frets or land surfaces of the cover, airflow encountering the first segment of the dimple will be relatively smooth, and the secondary roughness provided by the sinusoidal function is more localized near the centroid. This can create a more preferred level of turbulence and thereby provide improved aerodynamic characteristics.

In one aspect, a golf ball having a plurality of dimples on a surface thereof is provided herein. At least a first group of the plurality of dimples has a cross-sectional dimple profile defined by a superposed function resulting from a sum of at least a first function and a second function. The first function can be defined by at least one of: a circular arc or a catenary curve. The second function can be a decaying sinusoidal function.

In one aspect, when the first function is defined by a catenary curve, the catenary curve can be defined by:

$$y_1 = \frac{c_d(\cosh(SF \cdot x) - 1)}{\cosh\left(SF \cdot \frac{D_D}{2}\right) - 1}$$

where $D_D$ is a diameter (in inches) of the cross-sectional dimple profile, ca is a chord depth (in inches) of the catenary curve, SF is a shape factor of the catenary curve, and x is a radial distance (in inches) from a centroid of the cross-sectional dimple profile. The x-coordinate of x=0 corresponds to the centroid of the cross-sectional dimple profile, and a three-dimensional dimple geometry is generated via rotation about x=0.

In one example, the second function can be a positive decaying sinusoidal function defined by:

$$y(x) = \alpha c_d e^{-kx} \cos(bx)$$

where $\alpha$ is an amplitude factor and $0.01 \leq \alpha \leq 1$, $c_d$ is a chord depth (in inches) of a circular arc or a catenary curve (i.e., the first function), k is a decay constant, b is an oscillation frequency constant, and x is a radial distance (in inches) from a centroid of the cross-sectional dimple profile. The x-coordinate of x=0 corresponds to the centroid of the cross-sectional dimple profile, and a three-dimensional dimple geometry is generated via rotation about x=0.

The oscillation frequency constant b can be defined by:

$$b = \frac{2\pi n}{D_D}$$

where $D_D$ is a diameter (in inches) of the cross-sectional dimple profile, and n is a quantity of sinusoidal oscillations defined by the cross-sectional dimple profile between x=0 and x=($D_D$/2). One of ordinary skill in the art would understand that 2n is the quantity of sinusoidal oscillations defined by the entirety of the dimple profile. The quantity of sinusoidal oscillations n can be an integer or can be a non-integer.

The oscillation frequency constant b can be within the range defined by: $25 \leq b \leq 650$.

The decay constant k can be within the range defined by: $1 \leq k \leq 30$.

The second function can be a negative decaying sinusoidal function defined by:

$$y(x) = -\alpha c_d e^{-kx} \cos(bx)$$

In another aspect, a golf ball having a plurality of dimples on a surface thereof is disclosed herein. At least a first group of the plurality of dimples has a cross-sectional dimple profile defined by a sum of at least a first function and a second function. The first function can be defined by a circular arc or a catenary curve. The second function can be defined by one of the following:

$$y(x) = \alpha c_d e^{-kx} \cos(bx); \text{ or} \quad \text{(i)}$$

$$y(x) = -\alpha c_d e^{-kx} \cos(bx), \quad \text{(ii)}$$

where $\alpha$ is an amplitude factor and $0.01 \leq \alpha \leq 1$, ca is a chord depth (in inches) of the circular arc or the catenary curve (i.e., the first function), k is a decay constant, b is an oscillation frequency constant, and x is a radial distance (in inches) from a centroid of the cross-sectional dimple profile. The x-coordinate x=0 corresponds to the centroid of the cross-sectional dimple profile, and the three-dimensional dimple geometry is generated via rotation about x=0.

Additional aspects of the present disclosure are described in further detail herein.

BRIEF DESCRIPTION OF DRAWINGS

These and other aspects of the present invention may be more fully understood with references to, but not limited by, the following drawings.

DETAILED DESCRIPTION

Figure 1A:
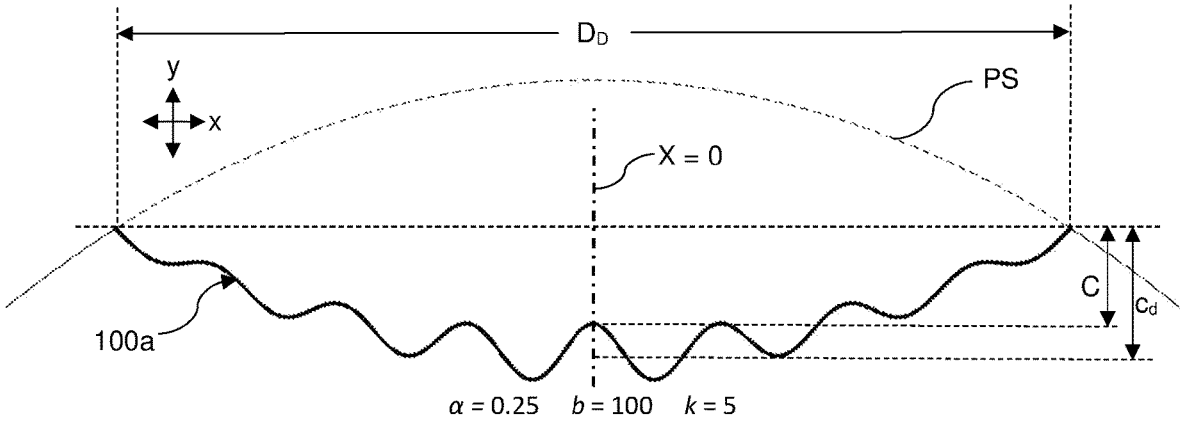
FIG. 1A illustrates a first dimple profile created from the superposing of a circular function and a decaying positive sinusoidal function according to one aspect.

The present disclosure is directed to a golf ball which comprises dimples having a cross section defined by the superposition of two or more continuous and differentiable functions. Additionally, the dimples preferably have a circular boundary and maintain an axis coincident with the center of the circular boundary.

Dimples that are defined by superposed curves provide greater opportunity to control the dimple cross-section and therefore, provide dimples that improve the flight characteristics of the golf ball. In embodiments herein where the dimple shape is axially symmetric and maintains a circular boundary, hob and cavity manufacture remains similar to those for conventionally shaped prior art dimple profiles.

The Superposition Principle states that for linear homogenous ordinary differential equations, if y1(x) and y2(x) yield valid solutions, then the sum of y1(x) and y2(x) will also yield a valid solution. This allows the combination of equations that are continuous and differentiable, and combining their solutions creates unique dimple profiles.

The disclosed dimple shape parameters allow for greater flexibility in defining the final profile, including the dimple depth as defined by the distance from the center point of the dimple to the curved phantom surface and the edge angle as defined in U.S. Pat. No. 6,162,136, which is incorporated by reference in its entirety as if fully set forth herein. In one aspect, the depths of the dimples are about 0.002 inches to 0.020 inches. In another aspect, the depths of the dimples are about 0.001 inches to 0.030 inches. With the superposition of the functions as set forth in this disclosure, the range of potential edge angles of the dimple can be significantly wide. In one example, edge angles of 0 degrees to 40 degrees are preferred.

Golf ball dimple profiles defined using catenary curves are further disclosed, for example, in U.S. Pat. No. 7,641,572, which is incorporated by reference in its entirety as if fully set forth herein. Golf ball dimple profiles defined using various superposition profiles are disclosed in U.S. Patent Application Publication Nos. 2008/0220907, 2012/0122613, 2016/0129314, and 2020/0398115, each of which are hereby incorporated by reference in their entirety as if fully set forth herein.

In aspects of the present disclosure, a golf ball dimple profile is defined via the superposition or sum of at least two functions in which one of the functions has a decaying profile or reduced impact on the golf ball dimple profile in a predetermined region or portion of the golf ball dimple profile. One of the functions of the superposed function can be dampened or decay in a direction emanating outward from the centroid of the dimple profile. Oscillations of the decaying function can be most pronounced or prominent at the centroid and less pronounced around a periphery of the dimple profile (i.e., near the frets or land surface of the golf ball cover). This configuration can provide a golf ball dimple profile in which the amplitude of at least one of the oscillating or sinusoidal functions defining the golf ball dimple profile decreases in regions near a dimple-free landing area surrounding the dimples. Suppression of the oscillations near the frets encourages a smoother airflow as air first encounters the dimple, and any roughness or turbulence that is promoted near the centroid of the dimple profile can be more localized. This configuration can therefore promote a more preferred turbulence effect and improve aerodynamics.

In one example, a golf ball having a plurality of dimples on a surface thereof is provided. At least a first group of the plurality of dimples has a cross-sectional dimple profile defined by a sum of at least a first function and a second function. One of ordinary skill in the art would understand that all of the dimples on a golf ball can include the dimple profile as defined herein. In other examples, a specific subset of dimples can include the dimple profile as defined herein.

In one example, the first function can be defined by a circular arc or function. In another example, the first function can be defined by a catenary curve or function. In other examples, the first function can be defined by an elliptical arc with the major axis along the x-direction, an elliptical arc with the minor axis along the x-direction, a polynomial function of order two or higher, preferably an even polynomial function of order two or higher, or a logarithmic function.

The second function of the superposed profile can be comprised of a decaying sinusoidal function, in one example. In another example, multiple functions that comprise the superposed profile can have a decaying profile. The first function of the superposed profile can be defined by any another function, which is not decaying. In another example, the first function can also have a decaying profile. More than two functions can be used to define the golf ball dimple profile.

The second function can be defined by a positive or negative periodic, sinusoidal, oscillating, or other type of function. In one aspect, the second function is a positive decaying sinusoidal function defined by:

$$y(x) = \alpha c_d e^{-kx} \cos(bx)$$

In the above function, a is an amplitude factor, ca is a chord depth (in inches) of the first function (i.e., the circular arc or the catenary curve), k is a decay constant, b is an oscillation frequency constant, and x is a radial distance (in inches) from a centroid of the cross-sectional dimple profile. The three-dimensional dimple geometry is defined by rotation about x=0, which is the centroid of the cross-sectional dimple profile. The centroid and chord depth $c_d$ are shown in FIG. 1A. The chord depth $c_d$ can be 0.001 inches-0.010 inches in some examples. Unless otherwise specified herein, the term "chord depth" refers to a chord depth of the first function.

Figure 2A:
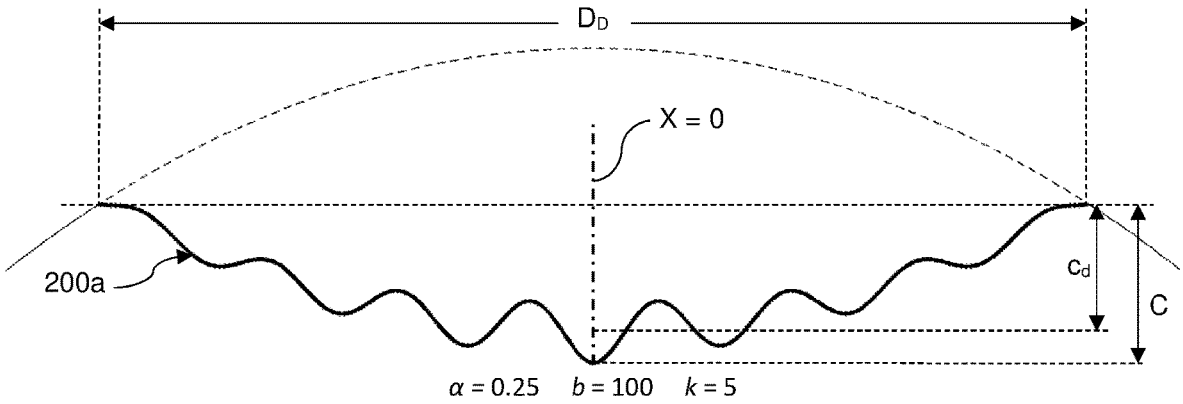
FIG. 2A illustrates a first dimple profile created from the superposing of a circular function and a decaying negative sinusoidal function according to one aspect.

As shown in FIGS. 1A and 2A, the chord depths ca correspond to a depth of the first function (i.e., the circular arc or catenary curve) isolated from the superposition with the second function. FIG. 4D further illustrates an exemplary chord depth $c_d$ of a first function consisting of a circular arc in relation to a superposed function consisting of the first function and a second function (i.e., decaying sinusoidal function). FIG. 4F further illustrates an exemplary chord depth $c_d$ of a first function consisting of a catenary curve in relation to a superposed function consisting of the first function and a second function (i.e., decaying sinusoidal function).

Additional annotations are provided in FIGS. 1A and 2A for a central depth C of the dimple profiles, which corresponds to a depth of the superposition function defining the dimple profiles at the centroid or x=0. In the positive decaying sinusoidal function example of FIG. 1A, the chord depth $c_d$ is larger than the central depth C. In the negative decaying sinusoidal function example of FIG. 2A, the chord depth $c_d$ is smaller than the central depth C. The difference between the chord depth $c_d$ and the central depth C is caused by the superposition with the second function, i.e., the decaying sinusoidal function.

In one aspect, if a positive decaying sinusoidal function is used, then the largest peak of the positive decaying sinusoidal function is located at the centroid of the cross-sectional dimple profile. In one aspect, if a negative decaying sinusoidal function is used, then the lowest trough or valley of the negative decaying sinusoidal function is located at the centroid of the cross-sectional dimple profile.

The amplitude factor α can be related to an amplitude A of the second function (i.e., the sinusoidal function) as a function of the chord depth ca. In one example, the value of the amplitude factor α can be defined by: $0.01 \leq \alpha \leq 1.0$. One of ordinary skill in the art would understand that the value of the amplitude factor α can vary. For example, the amplitude factor α can be 0.25 when the amplitude A of the second function is 0.0025 and the chord depth $c_d$ is 0.010. The amplitude A defined at the center of the cross-sectional dimple profile can be 10%-90% of the chord depth $c_d$, in one example. In another example, the amplitude A defined at the center of the cross-sectional dimple profile can be 25%-75% of the chord depth $c_d$. In yet another example, the amplitude A defined at the center of the cross-sectional dimple profile can be 40%-60% of the chord depth $c_d$. In yet another example, the amplitude A defined at the center of the cross-sectional dimple profile can be 10%-50% of the chord depth $c_d$.

The amplitude A can be limited by the chord depth $c_d$, such that the dimple profile is defined entirely below the phantom ball surface. One of ordinary skill in the art would understand that the value of the amplitude A can vary.

The decay constant k can be a predetermined value or element. In one example, the decay constant k can be defined within the range of: $1 \leq k \leq 30$. One of ordinary skill in the art would understand that the value of the decay constant k can vary.

The oscillation frequency constant b can be defined by:

$$b = \frac{2\pi n}{D_D}$$

where $D_D$ is a diameter (in inches) of the cross-sectional dimple profile, and n is a quantity of sinusoidal oscillations defined by the cross-sectional dimple profile between x=0 and $x=(D_D/2)$. In one aspect, $x=(D_D/2)$ can define the periphery of the cross-sectional dimple profile, i.e., the frets of the dimple.

The quantity of sinusoidal oscillations n can be 0.5-20.5. In one example, the quantity of sinusoidal oscillations n is 1.5-15.5. In one example, the quantity of sinusoidal oscillations n can be an integer. In another example, the quantity of sinusoidal oscillations n can be a non-integer.

The oscillation frequency constant b can be within the range defined by: $25 \leq b \leq 650$.

In examples in which the first function is defined by a catenary curve, the catenary curve can be defined by:

$$y_1 = \frac{c_d(\cosh(SF \cdot x) - 1)}{\cosh\left(SF \cdot \frac{D_D}{2}\right) - 1}$$

where $D_D$ is a diameter (in inches) of the cross-sectional dimple profile, $c_d$ is a chord depth (in inches) of the catenary curve, and SF is a shape factor of the catenary curve.

The shape factor SF can be an independent variable in the mathematical function that defines a catenary dimple cross-sectional shape, as further disclosed in, for example, U.S. Pat. Nos. 6,796,912, 7,163,472, 7,491,137, 7,887,439, and 9,782,628, which are each commonly assigned to Acushnet Company, and which are each hereby incorporated by reference in their entirety as if fully set forth herein. In one aspect, values of the shape factor SF that are closer to 1 appear to be more spherical in shape, while much larger values of the shape factor SF appear to be more cylindrical in shape. Exemplary values of the shape factor SF can be 10-300, in one example.

The second function can be a negative decaying sinusoidal function defined by:

$$y(x) = -\alpha c_d e^{-kx} \cos(bx)$$

The variables for this negative decaying sinusoidal function can be identical as the variables described herein for the positive decaying sinusoidal function.

In another exemplary configuration, a golf ball is provided that has a plurality of dimples on a surface thereof. At least a first group of the plurality of dimples has a cross-sectional dimple profile defined by a sum of at least a first function and a second function. The first function can be defined by a circular arc or function, or a catenary curve or function. The second function is defined by one of the following:

$$y(x) = \alpha c_d e^{-kx} \cos(bx); \text{ or} \quad \text{(i)}$$

$$y(x) = -\alpha c_d e^{-kx} \cos(bx). \quad \text{(ii)}$$

Exemplary profiles for dimples are illustrated in FIGS. 1A-3B, which are described in further detail herein.

Figure 1B:
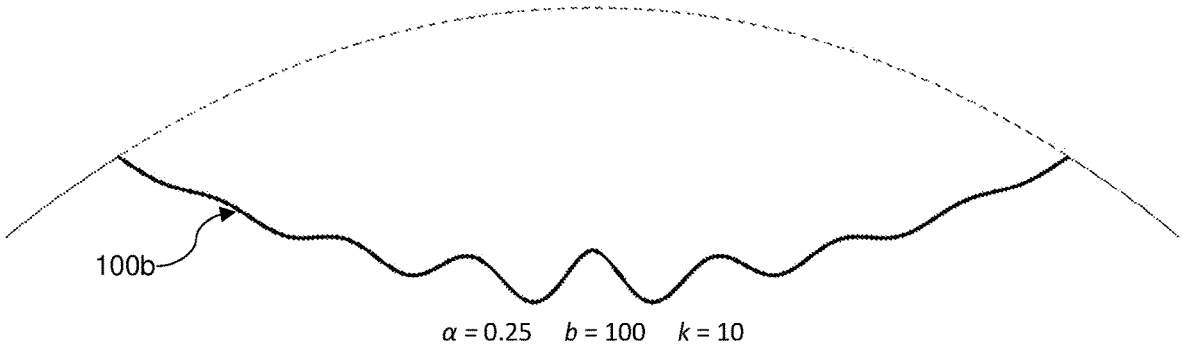
FIG. 1B illustrates a second dimple profile created from the superposing of a circular function and a decaying positive sinusoidal function according to one aspect.
Figure 1C:
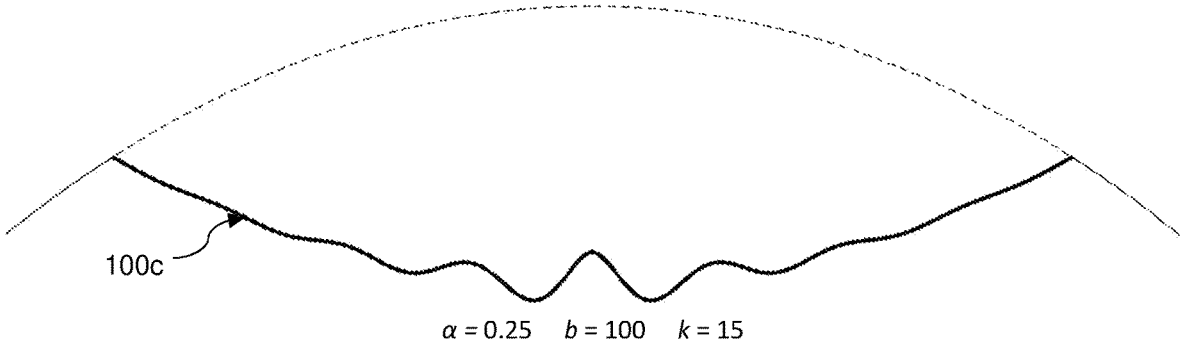
FIG. 1C illustrates a third dimple profile created from the superposing of a circular function and a decaying positive sinusoidal function according to one aspect.
Figure 1D:
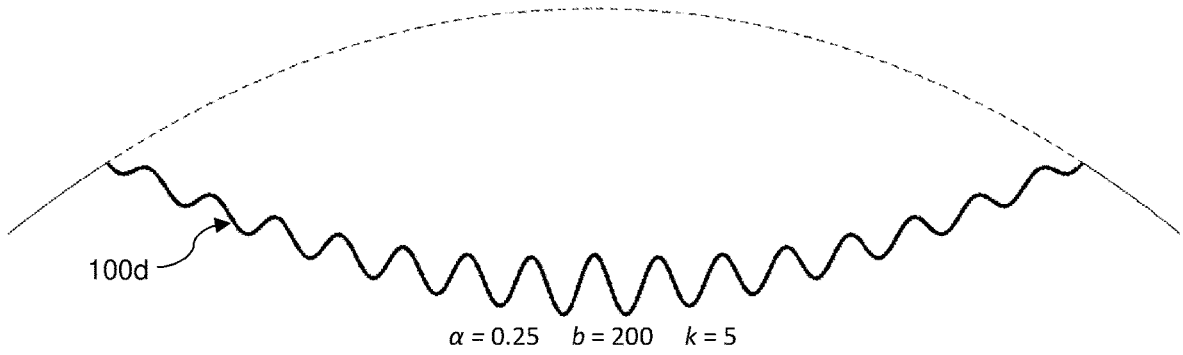
FIG. 1D illustrates a fourth dimple profile created from the superposing of a circular function and a decaying positive sinusoidal function according to one aspect.
Figure 1E:
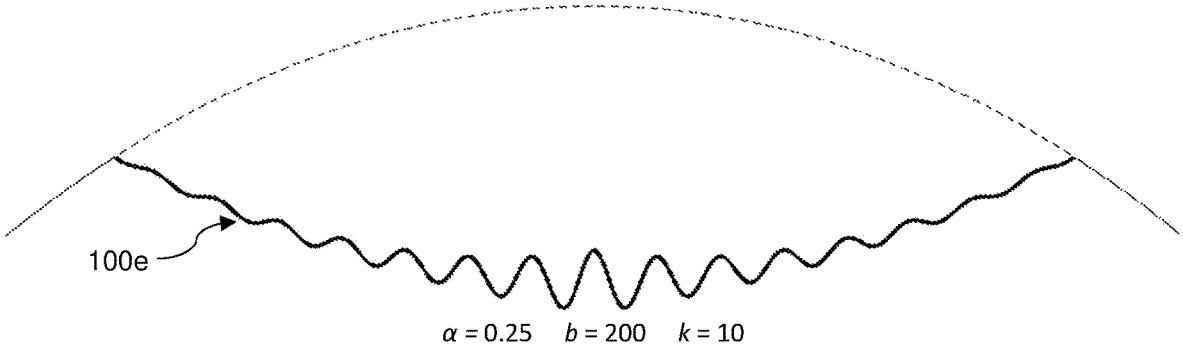
FIG. 1E illustrates a fifth dimple profile created from the superposing of a circular function and a decaying positive sinusoidal function according to one aspect.
Figure 1F:
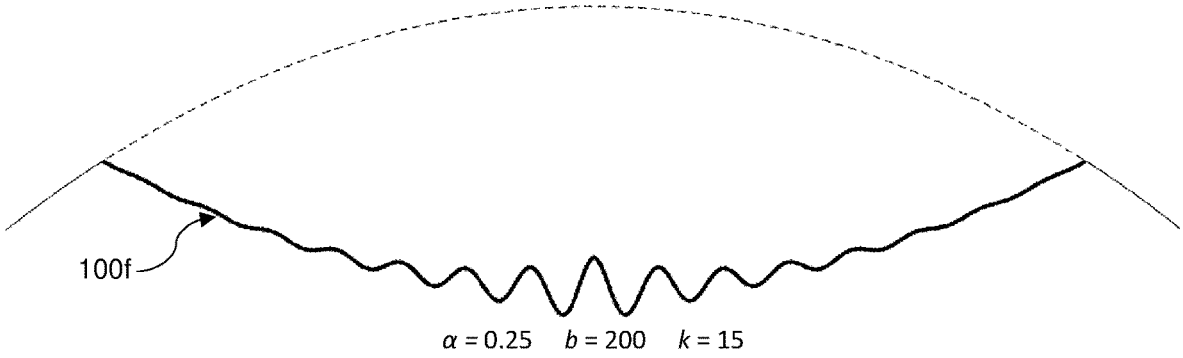
FIG. 1F illustrates a sixth dimple profile created from the superposing of a circular function and a decaying positive sinusoidal function according to one aspect.
Figure 2B:
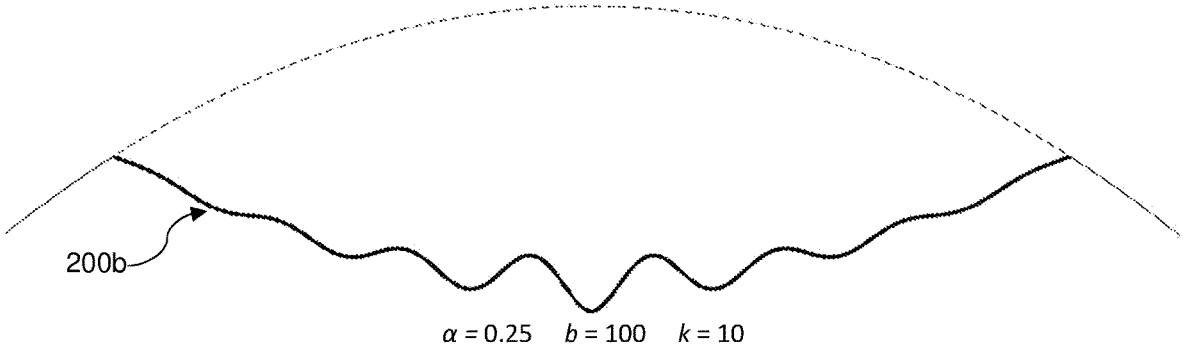
FIG. 2B illustrates a second dimple profile created from the superposing of a circular function and a decaying negative sinusoidal function according to one aspect.
Figure 2C:
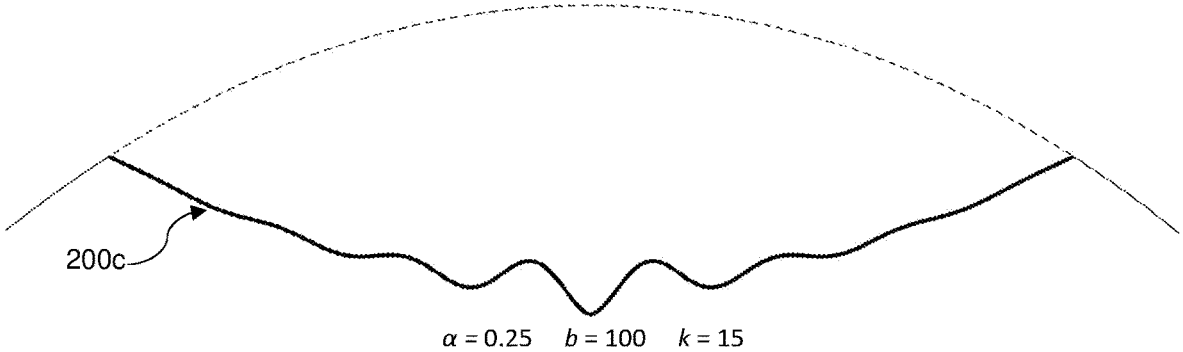
FIG. 2C illustrates a third dimple profile created from the superposing of a circular function and a decaying negative sinusoidal function according to one aspect.

FIGS. 1A-2C illustrate dimple profiles defined by superposed functions resulting from a sum of a circular profile and a decaying sinusoidal function. More specifically, FIGS. 1A-1F illustrate dimple profiles defined by superposed functions resulting from a sum of a circular profile and a positive decaying sinusoidal function, while FIGS. 2A-2C illustrate dimple profiles defined by superposed functions resulting from a sum of a circular profile and a negative decaying sinusoidal function.

Referring to FIG. 1A, a dimple profile 100*a* defined by superposed functions resulting from a sum of a circular profile and a positive decaying sinusoidal function is illustrated having the following characteristics: α=0.25; b=100; k=5. FIG. 1A further includes illustrations for a phantom surface (PS) of the golf ball, the chord depth ($c_d$), central depth (C), and centroid (x=0) of the dimple profile.

Referring to FIG. 1B, a dimple profile 100*b* defined by superposed functions resulting from a sum of a circular profile and a positive decaying sinusoidal function is illustrated having the following characteristics: α=0.25; b=100; k=10.

Referring to FIG. 1C, a dimple profile 100*c* defined by superposed functions resulting from a sum of a circular profile and a positive decaying sinusoidal function is illustrated having the following characteristics: $\alpha$=0.25; b=100; k=15.

Referring to FIG. 1D, a dimple profile 100*d* defined by superposed functions resulting from a sum of a circular profile and a positive decaying sinusoidal function is illustrated having the following characteristics: $\alpha$=0.25; b=200; k=5.

Referring to FIG. 1E, a dimple profile 100*e* defined by superposed functions resulting from a sum of a circular profile and a positive decaying sinusoidal function is illustrated having the following characteristics: $\alpha$=0.25; b=200; k=10.

Referring to FIG. 1F, a dimple profile 100*f* defined by superposed functions resulting from a sum of a circular profile and a positive decaying sinusoidal function is illustrated having the following characteristics: $\alpha$=0.25; b=200; k=15.

Referring to FIG. 2A, a dimple profile 200*a* defined by superposed functions resulting from a sum of a circular profile and a negative decaying sinusoidal function is illustrated having the following characteristics: $\alpha$=0.25; b=100; k=5.

Referring to FIG. 2B, a dimple profile 200*b* defined by superposed functions resulting from a sum of a circular profile and a negative decaying sinusoidal function is illustrated having the following characteristics: $\alpha$=0.25; b=100; k=10.

Referring to FIG. 2C, a dimple profile 200*c* defined by superposed functions resulting from a sum of a circular profile and a negative decaying sinusoidal function is illustrated having the following characteristics: $\alpha$=0.25; b=100; k=15.

Figure 3A:
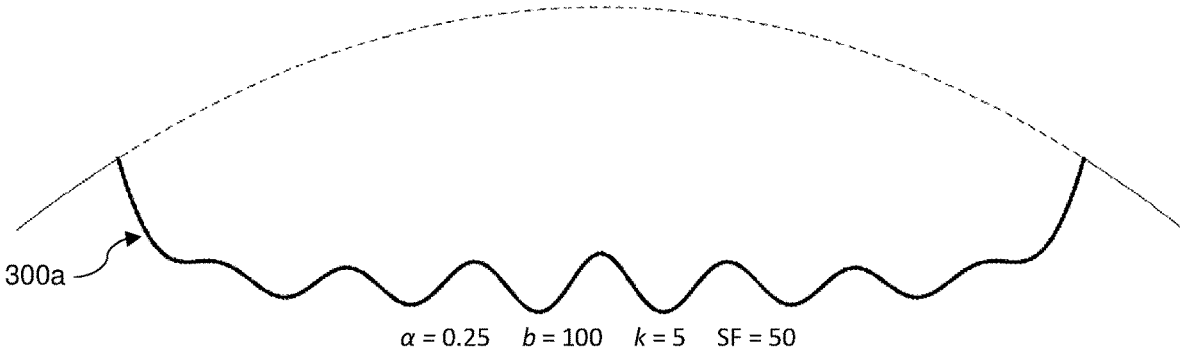
FIG. 3A illustrates a dimple profile created from the superposing of a catenary function and a decaying positive sinusoidal function according to one aspect.

FIG. 3A illustrates a dimple profile 300*a* defined by superposed functions resulting from a sum of a catenary curve function and a positive decaying sinusoidal function having the following characteristics: $\alpha$=0.25; b=100; k=5; SF=50.

Figure 3B:
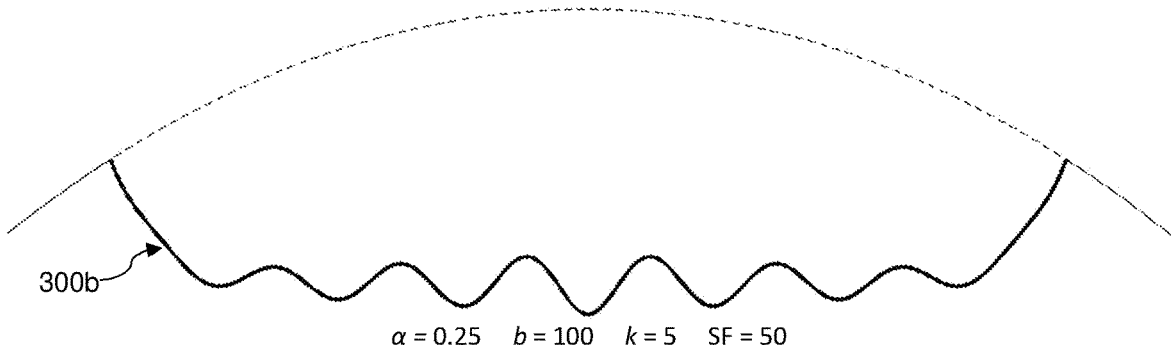
FIG. 3B illustrates a dimple profile created from the superposing of a catenary function and a decaying negative sinusoidal function according to one aspect.

FIG. 3B illustrates a dimple profile 300*b* defined by superposed functions resulting from a sum of a catenary curve function and a negative decaying sinusoidal function having the following characteristics: $\alpha$=0.25; b=100; k=5; SF=50.

One of ordinary skill in the art would appreciate from the present disclosure that the values for any of the parameters (i.e., a, b, $c_d$, k, n, SF, $D_D$, etc.) in FIGS. 1A-3B can vary.

Figure 4A:
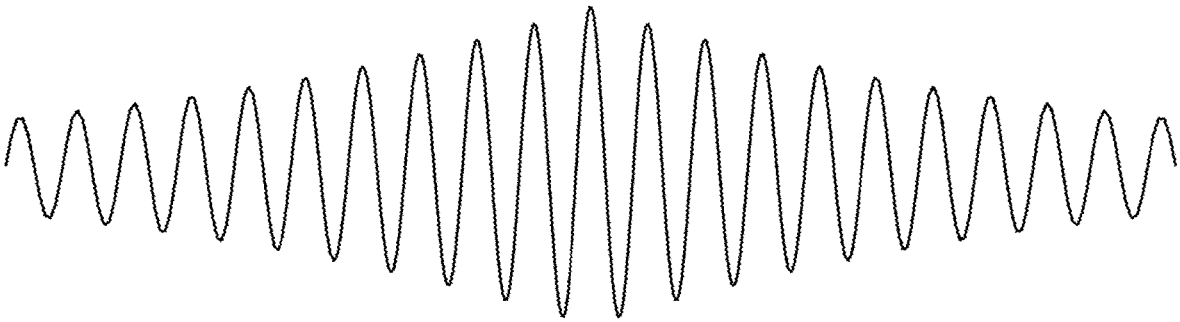
FIG. 4A is an exemplary plot of a decaying positive sinusoidal function.
Figure 4B:
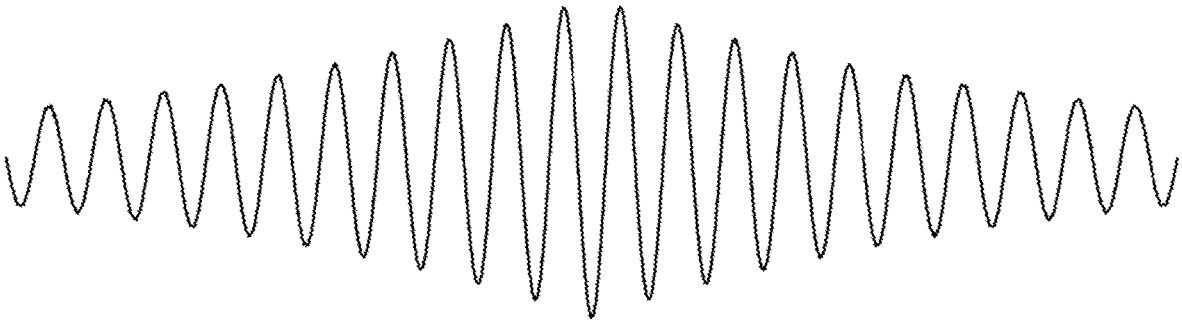
FIG. 4B is an exemplary plot of a decaying negative sinusoidal function.
Figure 4C:
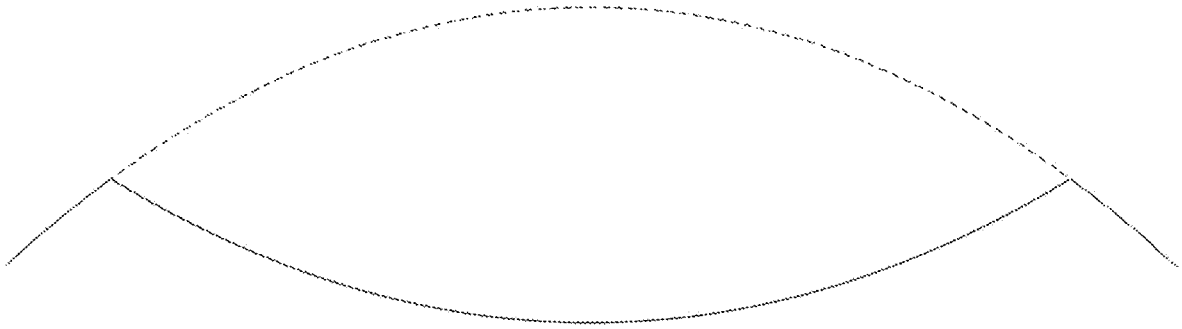
FIG. 4C is an exemplary plot of a circular arc function.
Figure 4D:
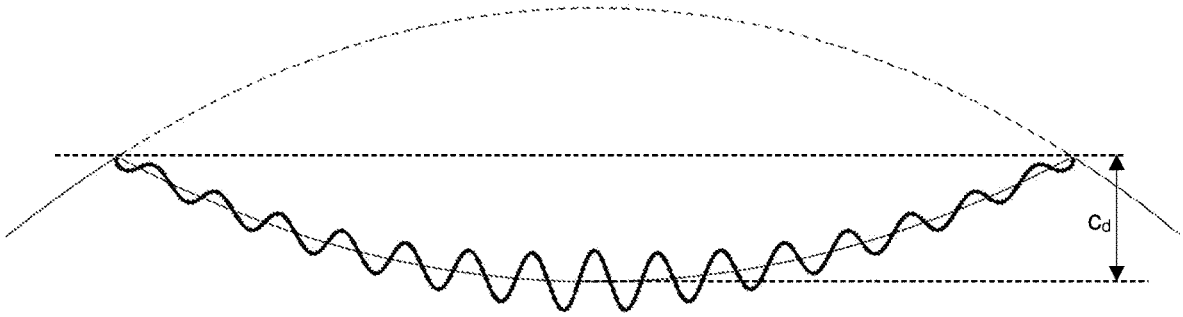
FIG. 4D is an exemplary plot of the circular arc function of FIG. 4C, and a superimposed function comprising the circular arc function and a decaying sinusoidal function.
Figure 4E:
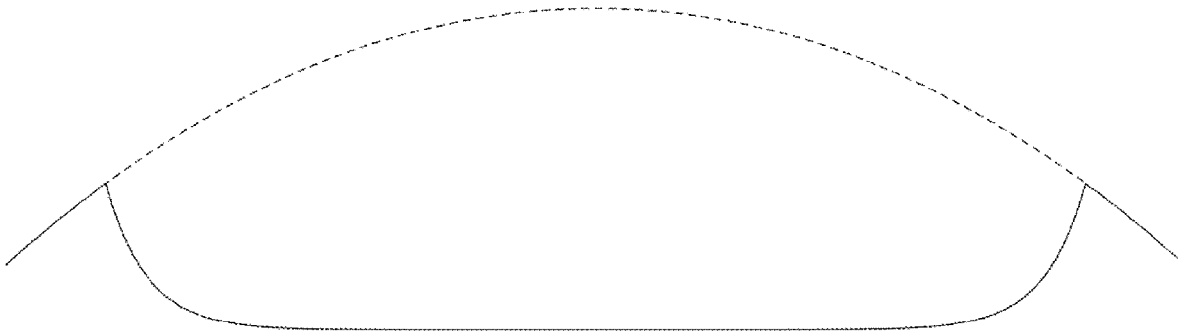
FIG. 4E is an exemplary plot of a catenary curve function.
Figure 4F:
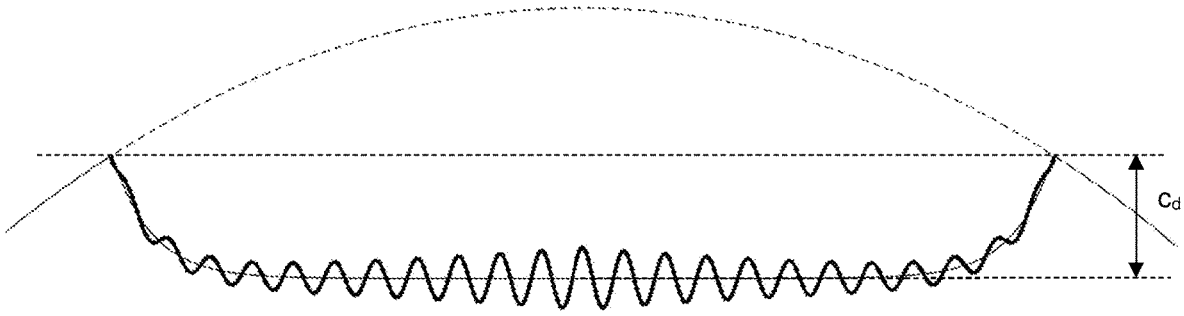
FIG. 4F is an exemplary plot of the catenary curve function of FIG. 4E, and a superimposed function comprising the catenary curve function and a decaying sinusoidal function.

For illustrative purposes, exemplary plots of the first functions (i.e., a circular arc or a catenary curve) and the second functions (i.e., decaying sinusoidal functions) are shown in FIGS. 4A-4F. More specifically, FIG. 4A is an exemplary plot of a decaying positive sinusoidal function in isolation, and FIG. 4B is an exemplary plot of a decaying negative sinusoidal function in isolation.

FIG. 4C is an exemplary plot of a circular arc function in isolation relative to a phantom surface. FIG. 4D is an exemplary superposed function plot consisting of the circular arc of FIG. 4C which is overlaid relative to an associated decaying sinusoidal function.

FIG. 4E is an exemplary plot of a catenary curve function in isolation relative to a phantom surface. FIG. 4F is an exemplary superposed function plot consisting of the catenary curve function of FIG. 4E which is overlaid relative to an associated decaying sinusoidal function.

Each of these Figures illustrate a specific type of these functions, although one of ordinary skill in the art would understand based on this disclosure that the variables and parameters of each of these functions can vary.

Golf balls of the present disclosure include at least one dimple on the surface thereof having a profile defined by a superposed function resulting from the sum of two or more functions, and, optionally, additionally include one or more dimples having a profile that cannot be defined by a superposed function resulting from the sum of two or more functions.

In a particular aspect of embodiments of the present disclosure wherein the golf ball includes dimples having a superposed function profile and dimples having a profile other than a superposed function profile, each of the dimples having a superposed function profile can have a dimple diameter of 0.180 inches or greater, or a dimple diameter of 0.200 inches or greater, and each of the dimples having a profile other than a superposed function profile can have a dimple diameter of less than 0.180 inches. In one aspect, the dimple diameter can be no greater than 0.125 inches. In another aspect, the dimple diameter can be at least 0.0625 inches. In one aspect, the dimple diameter can be 0.050 inches-0.150 inches. In one aspect, the dimple diameter can be 0.050 inches-0.1875 inches. One of ordinary skill in the art would understand that the dimple diameter can vary.

The superposition method disclosed herein can generate dimple profiles that have not been utilized on prior art golf balls. Since the dimple boundaries of the golf ball are preferably circular, previously developed patterns can be utilized, refined and optimized for potentially improved distance and flight control. The visual appearance of golf balls produced from this method can be significantly different. The present disclosure may be used with any type of ball construction. For instance, the ball may have a 2-piece construction, a double cover or veneer cover construction or other multi-layer constructions depending on the type of performance desired of the ball. Examples of these and other types of ball constructions that may be used with the present disclosure include those described in U.S. Pat. Nos. 5,713,801, 5,803,831, 5,885,172, 5,919,100, 5,965,669, 5,981,654, 5,981,658, and 6,149,535, each of which are hereby incorporated by reference in their entirety as if fully set forth herein. Different materials also may be used in the construction of the golf balls made with the present disclosure. For example, the cover of the ball may be made of polyurethane, ionomer resin, balata or any other suitable cover material known to those skilled in the art. Different materials also may be used for forming core and intermediate layers of the ball.

After selecting the desired ball construction, the flight performance of the golf ball can be adjusted according to the design, placement, and number of dimples on the ball. As explained above, the use of a variety of dimples, based on a superposition profile, provides a relatively effective way to modify the ball flight performance without significantly altering the dimple pattern. Thus, the use of dimples based on the superposition profile allows a golf ball designer to select flight characteristics of a golf ball in a similar way that different materials and ball constructions can be selected to achieve a desired performance.

Each dimple of the present disclosure is part of a dimple pattern selected to achieve a particular desired lift coefficient. Dimple patterns that provide a high percentage of surface coverage are preferred, and are well known in the art. For example, U.S. Pat. Nos. 5,562,552, 5,575,477, 5,957,787, 5,249,804, and 4,925,193, each of which are hereby incorporated by reference in their entirety as if fully set forth herein, disclose geometric patterns for positioning dimples on a golf ball.

In one embodiment of the present disclosure, the dimple pattern is at least partially defined by phyllotaxis-based patterns, such as those described in U.S. Pat. No. 6,338,684, which is hereby incorporated by reference in its entirety as if fully set forth herein. Preferably a dimple pattern that provides greater than about 70% surface coverage, or greater than about 75% surface coverage, or greater than about 80% surface coverage, is selected. Once the dimple pattern is selected, several alternative dimple profiles can be tested in a wind tunnel or indoor test range to empirically determine the properties of the profiles that provide the desired lift and drag coefficients at the desired launch conditions.

While the present disclosure has been described in conjunction with specific embodiments, it is evident that numerous alternatives, modifications, and variations will be apparent to those skilled in the art in light of the foregoing description.

What is claimed is:

1. A golf ball having a plurality of dimples on a surface thereof, wherein at least a first group of the plurality of dimples has a cross-sectional dimple profile defined by a superposed function resulting from a sum of at least a first function and a second function, wherein the first function is defined by at least one of: a circular arc or a catenary curve, and the second function is a decaying sinusoidal function.

2. The golf ball according to claim 1, wherein the first function is defined by the circular arc.

3. The golf ball according to claim 1, wherein the second function is a positive decaying sinusoidal function defined by:

$$y(x) = \alpha c_d e^{-kx} \cos(bx)$$

where $\alpha$ is an amplitude factor, and $0.01 \leq \alpha \leq 1$, $c_d$ is a chord depth (in inches) of the first function, k is a decay constant, b is an oscillation frequency constant, and x is a radial distance (in inches) from a centroid of the cross-sectional dimple profile, wherein x=0 corresponds to the centroid of the cross-sectional dimple profile, and a three-dimensional dimple geometry is generated via rotation about x=0.

4. The golf ball according to claim 3, wherein an amplitude of a sinusoidal oscillation defined at a center of the cross-sectional dimple profile is 10%-90% of the chord depth $c_d$.

5. The golf ball according to claim 3, wherein an amplitude of a sinusoidal oscillation defined at a center of the cross-sectional dimple profile is 10%-50% of the chord depth $c_d$.

6. The golf ball according to claim 3, wherein the oscillation frequency constant b is defined by:

$$b = \frac{2\pi n}{D_D}$$

where $D_D$ is a diameter (in inches) of the cross-sectional dimple profile, and n is a quantity of sinusoidal oscillations defined by the cross-sectional dimple profile between x=0 and x=($D_D$/2).

7. The golf ball according to claim 6, wherein n is an integer.

8. The golf ball according to claim 6, wherein n is not an integer.

9. The golf ball according to claim 3, wherein the oscillation frequency constant b is within the range defined by: $25 \leq b \leq 650$.

10. The golf ball according to claim 3, wherein the decay constant k is within the range defined by: $1 \leq k \leq 30$.

11. The golf ball according to claim 1, wherein the first function is defined by a catenary curve, the catenary curve being defined by:

$$y_1 = \frac{c_d(\cosh(SF \cdot x) - 1)}{\cosh\left(SF \cdot \frac{D_D}{2}\right) - 1}$$

where $D_D$ is a diameter (in inches) of the cross-sectional dimple profile, and SF is a shape factor of the catenary curve.

12. The golf ball according to claim 1, wherein the second function is a negative decaying sinusoidal function defined by:

$$y(x) = -\alpha c_d e^{-kx} \cos(bx)$$

where $\alpha$ is an amplitude factor, and $0.01 \leq \alpha \leq 1$, $c_d$ is a chord depth (in inches) of the first function, k is a decay constant, b is an oscillation frequency constant, and x is a radial distance (in inches) from a centroid of the cross-sectional dimple profile, wherein x=0 corresponds to the centroid of the cross-sectional dimple profile, and a three-dimensional dimple geometry is generated via rotation about x=0.

13. The golf ball according to claim 12, wherein the oscillation frequency constant b is defined by:

$$b = \frac{2\pi n}{D_D}$$

where $D_D$ is a diameter (in inches) of the cross-sectional dimple profile, and n is a quantity of sinusoidal oscillations defined by the cross-sectional dimple profile between x=0 and x=($D_D$/2).

14. The golf ball according to claim 13, wherein the oscillation frequency constant b is within the range defined by: $25 \leq b \leq 650$.

15. The golf ball according to claim 12, wherein the decay constant k is within the range defined by: $1 \leq k \leq 30$.

16. A golf ball having a plurality of dimples on a surface thereof, wherein at least a first group of the plurality of dimples has a cross-sectional dimple profile defined by a sum of at least a first function and a second function, wherein the first function is defined by a circular arc or a catenary curve; and the second function is defined by one of the following:

$$y(x) = \alpha c_d e^{-kx}\cos(bx); \text{ or} \quad \text{(i)}$$

$$y(x) = -\alpha c_d e^{-kx}\cos(bx), \quad \text{(ii)}$$

where $\alpha$ is an amplitude factor, and $0.01 \leq \alpha \leq 1$, $c_d$ is a chord depth (in inches) of the first function, k is a decay constant, b is an oscillation frequency constant, and x is a radial distance (in inches) from a centroid of the cross-sectional dimple profile; and wherein x=0 corresponds to the centroid of the cross-sectional dimple profile, and a three-dimensional dimple geometry is generated via rotation about x=0.

17. The golf ball according to claim 16, wherein the first function is defined by the catenary curve, and the catenary curve is defined by:

$$y_1 = \frac{c_d(\cosh(SF \cdot x) - 1)}{\cosh\left(SF \cdot \frac{D_D}{2}\right) - 1}$$

where $D_D$ is a diameter (in inches) of the cross-sectional dimple profile, and SF is a shape factor of the catenary curve.

18. The golf ball according to claim 16, wherein the oscillation frequency constant b is defined by:

$$b = \frac{2\pi n}{D_D}$$

where $D_D$ is a diameter (in inches) of the cross-sectional dimple profile, and n is a quantity of sinusoidal oscillations defined by the cross-sectional dimple profile between x=0 and x=($D_D$/2).

19. The golf ball according to claim 18, wherein the quantity of sinusoidal oscillations is 1.5-15.5.

20. The golf ball according to claim 18, wherein an amplitude of a sinusoidal oscillation defined at a center of the cross-sectional dimple profile is 10%-50% of the chord depth $c_d$.

* * * * *